US008955555B2

(12) United States Patent
Cha

(10) Patent No.: US 8,955,555 B2
(45) Date of Patent: Feb. 17, 2015

(54) THREE-DIMENSIONAL WOVEN FABRIC AND METHOD FOR PRODUCING THE SAME

(71) Applicant: Ki-chul Cha, Daegu (KR)

(72) Inventor: Ki-chul Cha, Daegu (KR)

( * ) Notice: Subject to any disclaimer, the term of this patent is extended or adjusted under 35 U.S.C. 154(b) by 0 days.

(21) Appl. No.: 14/350,294

(22) PCT Filed: Jan. 11, 2013

(86) PCT No.: PCT/KR2013/000264

§ 371 (c)(1),
(2) Date: Apr. 7, 2014

(87) PCT Pub. No.: WO2013/109021

PCT Pub. Date: Jul. 25, 2013

(65) Prior Publication Data

US 2014/0261851 A1 Sep. 18, 2014

(30) Foreign Application Priority Data

Jan. 20, 2012 (KR) ..... 10-2012-0006684
Jul. 26, 2012 (KR) ..... 10-2012-0081735

(51) Int. Cl.

| | |
|---|---|
| ***E06B 9/40*** | (2006.01) |
| ***D03D 11/02*** | (2006.01) |
| ***E06B 9/24*** | (2006.01) |
| ***E06B 9/262*** | (2006.01) |

(Continued)

(52) U.S. Cl.

CPC *D03D 11/02* (2013.01); *E06B 9/24* (2013.01); *E06B 9/262* (2013.01); *D03D 1/06* (2013.01); *D10B 2403/021* (2013.01); *D10B 2503/03* (2013.01); *E06B 2009/2627* (2013.01); *E06B 2009/2423* (2013.01); *Y10S 139/01* (2013.01)

USPC ..... 139/383 R; 139/11; 139/DIG. 1; 160/237

(58) Field of Classification Search

CPC ..... E06B 9/40; E06B 9/24; E06B 2009/2405; E06B 9/42; E06B 2009/2627; E06B 9/26; E06B 9/582

USPC ..... 139/11, 383 R, DIG. 1

See application file for complete search history.

(56) References Cited

U.S. PATENT DOCUMENTS 2,280,358 A * 4/1942 Tietig ..... 160/120
3,854,517 A * 12/1974 Nakamura ..... 160/323.1
4,019,554 A * 4/1977 Rasmussen ..... 160/84.02

(Continued)

*Primary Examiner* — Bobby Muromoto, Jr.
(74) *Attorney, Agent, or Firm* — Perkins Coie LLP

(57) ABSTRACT

A three-dimensional woven fabric including front layer, rear layer, and light-shielding layer connecting front layer to rear layer and a method thereof are disclosed. The light-shielding layer is formed by repeatedly overlapping first, second, and third light-shielding layers with another light-shielding layer with adjacent ones among the first to the third light-shielding layers overlapped. The front layer includes front parts formed by weaving front layer wrap threads and weft threads, the front parts have front layer-connecting parts formed by sequentially and repeatedly weaving front layer wrapwrap threads and weft threads and light-shielding layer wrap threads, the rear layer includes rear layer-connecting parts formed by weaving sequentially and repeatedly the rear layer wrap threads and weft threads and light-shielding layer wrap threads. The light-shielding layers are formed by weaving light-shielding layer wrap threads and the weft threads, and the light-shielding layers are sequentially and repeatedly connected to front layer-connecting parts and rear layer-connecting parts. Three-dimensional shapes are implemented without adhesive. Various designs and light-shielding control are available.

8 Claims, 11 Drawing Sheets

(51) Int. Cl.
*D03D 1/06* (2006.01)
*D03D 25/00* (2006.01)

(56) References Cited

U.S. PATENT DOCUMENTS

| | | | | |
|---|---|---|---|---|
| 4,187,896 | A * | 2/1980 | Shore | 160/121.1 |
| 4,194,550 | A * | 3/1980 | Hopper | 160/121.1 |
| 4,453,584 | A * | 6/1984 | Steele | 160/121.1 |
| 5,855,235 | A * | 1/1999 | Colson et al. | 160/121.1 |
| 7,059,378 | B2 * | 6/2006 | Colson et al. | 160/121.1 |
| 7,267,156 | B2 * | 9/2007 | Byeon | 160/121.1 |
| 8,191,605 | B2 * | 6/2012 | Kwak | 160/319 |
| D683,990 | S * | 6/2013 | Huang | D6/577 |
| D686,023 | S * | 7/2013 | Tamez, Jr. | D6/576 |
| 2003/0136527 | A1 * | 7/2003 | Weiss | 160/271 |
| 2003/0221795 | A1 * | 12/2003 | Hsu | 160/84.01 |
| 2004/0198126 | A1 * | 10/2004 | Kunisada et al. | 442/394 |
| 2005/0086833 | A1 * | 4/2005 | FitzPatrick | 34/611 |
| 2005/0121149 | A1 * | 6/2005 | Shih et al. | 160/236 |
| 2005/0215147 | A1 * | 9/2005 | Masters et al. | 442/59 |
| 2006/0157136 | A1 * | 7/2006 | Sitarz et al. | 139/11 |
| 2009/0139664 | A1 * | 6/2009 | Graichen | 160/84.04 |
| 2009/0139665 | A1 * | 6/2009 | Cha | 160/87 |
| 2010/0132896 | A1 * | 6/2010 | Kazuma | 160/236 |
| 2010/0218841 | A1 * | 9/2010 | Chang et al. | 139/384 A |
| 2010/0288449 | A1 * | 11/2010 | Chang et al. | 160/237 |
| 2011/0036514 | A1 * | 2/2011 | Cha | 160/178.1 V |
| 2011/0209833 | A1 * | 9/2011 | Cha | 160/84.01 |
| 2011/0209834 | A1 * | 9/2011 | Lowry et al. | 160/84.04 |
| 2011/0220303 | A1 * | 9/2011 | Colson | 160/133 |
| 2012/0018108 | A1 * | 1/2012 | Lin | 160/340 |
| 2012/0085503 | A1 * | 4/2012 | Kotin | 160/174 V |
| 2012/0085504 | A1 * | 4/2012 | Cha | 160/236 |
| 2014/0261851 | A1 * | 9/2014 | Cha | 139/384 A |

* cited by examiner

THREE-DIMENSIONAL WOVEN FABRIC AND METHOD FOR PRODUCING THE SAME

TECHNICAL FIELD

The present invention relates to a three-dimensional woven fabric and a method of producing the same and, more particularly, to a three-dimensional woven fabric woven with threads into a woven fabric for blinds having a mesh-structured front layer, a mesh-structured rear layer, and a light shielding layer blocking light which can be woven by a single weaving machine and a single process, which have a changeable shape between a planar shape and a three-dimensional shape, and which can be used for a blind, and a method of producing the same.

BACKGROUND ART

In general, a curtain, a blind, or the like is installed on a window and/or an entrance and is used to block solar light and another's eyes and for the purpose of noise-proof, cold wind-proof, and the like, and in addition to these utilities, also serves as an important house-furnishing good to enhance interior esthetic appearance by mixing colors to match up an inner wall and window glasses.

An existing three-dimensional blind is disclosed as a blind, in U.S. Pat. No. 3,384,519, made by forming dual mesh-structured woven fabrics, disposing a movable blade therebetween, and bonding the mesh-structured woven fabrics with the blade.

The above-mentioned method controls quantity of light such that light enters inside through the mesh-structured woven fabrics when the blade change a pose into a horizontal pose, and that the blade returns to the vertical pose to block light through the mesh structure of the woven fabric. However, bonding between the blade and the woven fabrics by adhesive may be an interior pollution source and further property of the adhesive may be deteriorated by ultraviolet rays for a long use so that the bonding may be inferior and the blade and the woven fabrics may be separated from each other.

In order to overcome these disadvantages, Korean Patent No. 815579 proposed a three-dimensional woven fabric including a surface layer, a rear layer, and an intermediate layer connecting the surface layer to the rear layer by weaving. However, the disclosed three-dimensional woven fabric is made by forming a first intermediate layer and a second intermediate layer with two wrap threads to be connected to the surface layer and the rear layer and thus has a simple expression and a limit to block light.

DISCLOSURE OF INVENTION

Therefore, the present invention is made to solve the above problems.

In accordance with the present invention, a three-dimensional woven fabric including a light-transmittable front layer, a light-transmittable rear layer, and a half light-transmittable light-shielding layer connecting the front layer to the rear layer and a method thereof are provided. The light-shielding layer is formed by repeatedly overlapping first, second, and third light-shielding layers, with adjacent ones among first to third layers overlapped. In the front layer, are sequentially and repeatedly formed front parts in which front layer wrap threads and front layer weft threads are woven and front layer-connecting parts in which front layer wrap threads, front layer weft threads and the light-shielding layer's light-shielding layer wrap threads are woven. In the rear layer, are sequentially and repeatedly formed rear parts in which rear layer wrap threads and rear layer weft threads are woven and rear layer-connecting parts in which rear layer wrap threads, rear layer weft threads and the light-shielding layer's light-shielding layer wrap threads are woven. The light-shielding layers are formed by weaving light-shielding layer wrap threads and light-shielding layer weft threads, and the light-shielding layers are sequentially and repeatedly connected to the front layer-connecting parts and the rear layer-connecting parts.

According to the present invention, a woven fabric in which a three-dimensional shape may be implemented only by weaving without glue or adhesive may be provided.

In addition, the present invention may provide a three-dimensional woven fabric capable of expressing various design according to change of a three-dimensional shape and of blocking light.

BEST MODE FOR CARRYING OUT THE INVENTION

The present invention provides a three-dimensional woven fabric comprising: a front layer, a rear layer, and a light-shielding layer connecting the front layer to the rear layer. The light-shielding layer is repeatedly overlapped with another light-shielding layer adjacent to a first light-shielding layer, a second light-shielding layer, and a third light-shielding layer. The front layer includes front parts, in which front layer wrap threads and filings are basically woven, and first to third front layer-connecting parts, in which front layer wrap threads and wrap threads and filings forming the light-shielding layer are woven, which are sequentially and repeatedly formed. The rear layer includes rear parts, in which rear layer wrap threads and filings are basically woven, and first to third rear layer-connecting parts, in which the rear layer wrap threads and wrap threads and filings forming the light-shielding layer are woven, which are sequentially and repeatedly formed. The first to the third light-shielding layers are formed by weaving the wrap threads and the filings forming the light-shielding layer. The first to third light-shielding layers are connected to the first to third front layer-connecting parts and the first to third rear layer-connecting parts sequentially and repeatedly. The third rear layer-connecting parts are disposed on the rear layer facing the first front layer-connecting part of on the front layer. The first rear layer-connecting part is disposed on the rear layer facing the second front layer-connecting part on the front layer. The second rear layer-connecting part is disposed on the rear layer facing the third front layer-connecting part on the front layer. The first to the third rear layer-connecting parts are longer than the first to the third front layer-connecting parts and shorter than distances between the first to the third front layer-connecting parts, and the light-shielding layer connected to the respective rear layer-connecting parts is overlapped with another light-shielding layer connected and adjacent to a front layer-connecting part directly above a next-next rear layer connecting part.

Hereinafter, a three-dimensional woven fabric according to preferred embodiments of the present invention will be described in detail with reference to the accompanying drawings.

FIGS. 1 to 6 show a three-dimensional woven fabric according to an embodiment of the present invention.

Figure 1:
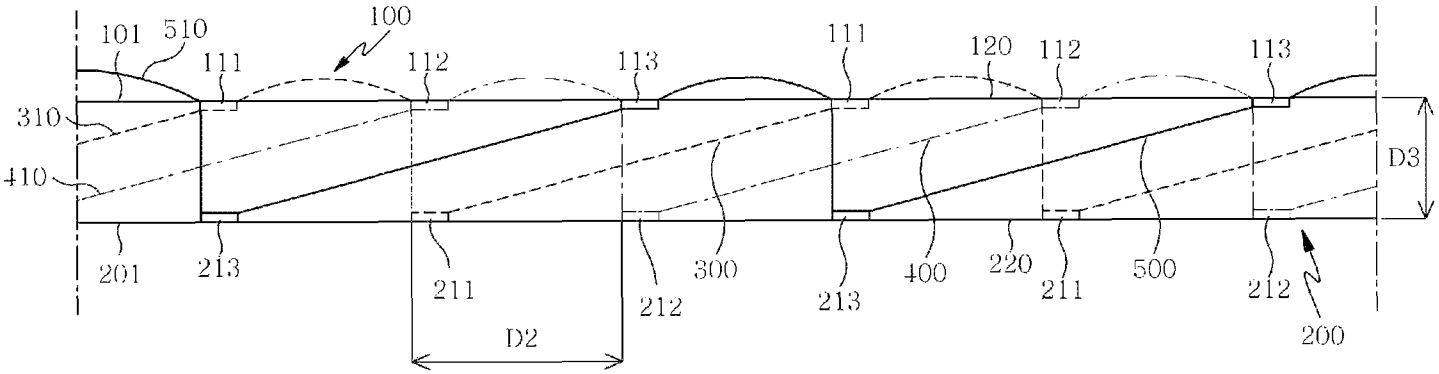
FIG. 1 is a schematic view illustrating a three-dimensional woven fabric according to an embodiment of the present invention.
Figure 3:
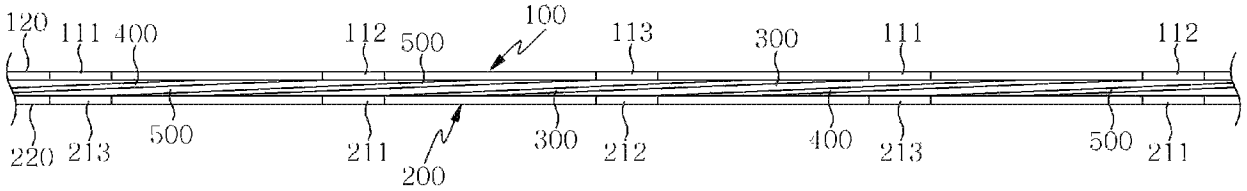
FIG. 3 is a side-sectional view illustrating a folded state of the three-dimensional woven fabric of FIG. 1.
Figure 4:
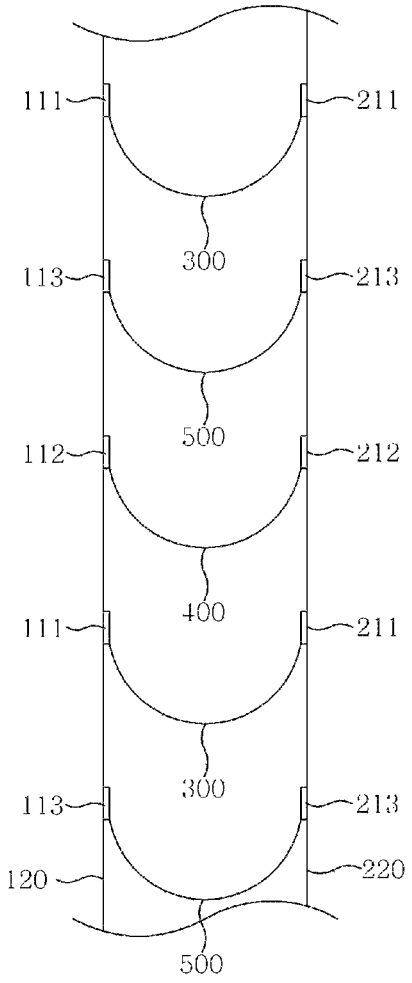
FIG. 4 is a side view illustrating a state of the three-dimensional woven fabric of FIG. 1 is completely unfolded.
Figure 5:
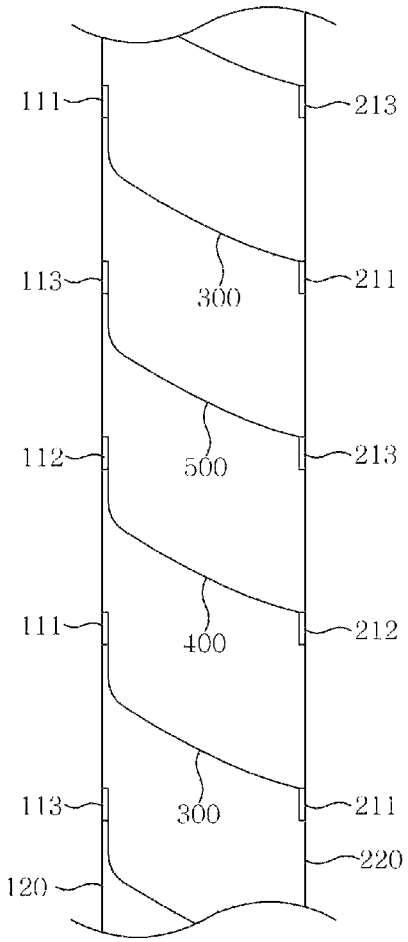
FIG. 5 is a side-sectional view illustrating a state that the three-dimensional woven fabric of FIG. 1 is unfolded about half.
Figure 6:
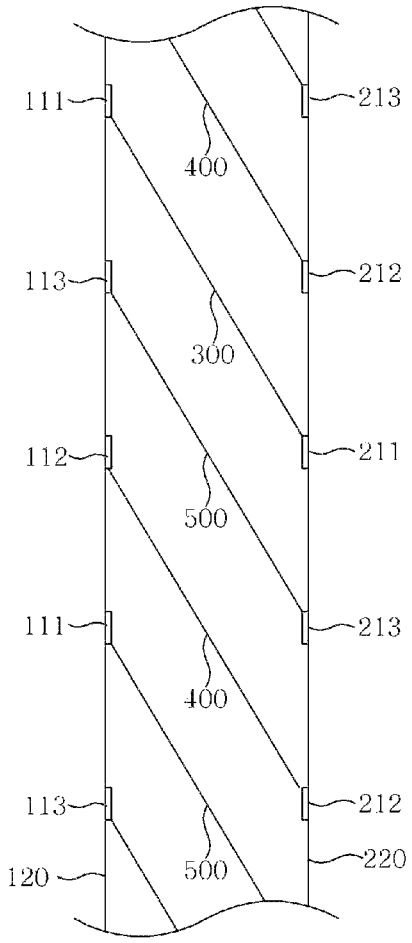
FIG. 6 is a side view illustrating the three-dimensional woven fabrics of FIG. 1 overlapped with each other.

As illustrated in FIG. 3, the three-dimensional woven fabric according to an embodiment of the present invention has a four-layer structure in which light-shielding layers are overlapped with each other when the three-dimensional woven fabric is folded. The three-dimensional woven fabric has a laminated structure when the fabric is woven. However, for the convenient purpose of illustration, FIG. 1 shows a front layer 100 and a rear layer 200 which are separated from each other and front layer wefts, rear layer wefts, and light-shielding wefts are omitted from FIG. 1 for the clearness.

The three-dimensional woven fabric includes a front layer 100 woven undensely in a mesh structure allowing light to transmit therethrough, a rear layer 200 woven undensely in a mesh structure allowing light to transmit therethrough, and a light-shielding layer woven densely to be half light-transmittable and disposed between the front layer 100 and the rear layer 200 to be woven such that ends thereof are connected the front layer 100 and the rear layer 200 and having first to third light-shielding layers 300, 400, and 500 which are repeated as a group.

The front layer 100 includes a front part 120 in which front layer wrap threads and front layer weft threads (not shown) are woven and first to third front layer-connecting parts 111, 112, and 113 in which the front layer wrap threads 101 and light-shielding layer wrap threads forming first to third light-shielding layers are woven with the front layer weft threads and spaced apart from each other by a distance D2.

The rear layer 200 includes a rear part 220 in which rear layer wrap threads 201 and rear layer weft threads (not shown) are woven and first to third rear layer-connecting parts 211, 212, and 213 as a group in which the rear layer wrap threads 201 and light-shielding layer wrap thread forming the first to third light-shielding layers are woven with the rear layer weft threads to be spaced apart from each other by a distance D2.

The third rear layer-connecting parts 213 are disposed on regions on the rear layer 200 facing the first front layer-connecting parts 111 of the front layer 110, the first rear layer-connecting parts 211 are disposed on regions on the rear layer 200 facing the second front layer-connecting parts 112 of the front layer 100, the second rear layer-connecting parts 212 are disposed on regions on the rear layer 200 facing the third front layer-connecting parts 113 of the front layer 100.

In a plurality of first light-shielding layers 300, the first light-shielding layer wrap threads 310 and the first light-shielding layer weft threads (not shown) are woven entirely, the first light-shielding layer wrap threads 310 are woven to the rear layer weft threads such that one ends of the first light-shielding layer wrap threads 310 are connected respectively to the plurality of the first rear layer-connecting parts 211, and the first light-shielding layer wrap threads 310 are woven to the front layer weft threads such that the other ends of the first light-shielding layer wrap threads 310 are connected respectively to the plurality of the first front layer-connecting parts 111.

In a plurality of second light-shielding layers 400, the second light-shielding layer wrap threads 410 and the second light-shielding layer weft threads (not shown) are woven entirely, the second light-shielding layer wrap threads 410 are woven to the rear layer weft threads such that one ends of the second light-shielding layer wrap threads 410 are connected respectively to the plurality of the second rear layer-connecting parts 212, and the second light-shielding layer wrap threads 410 are woven to the front layer weft threads such that the other ends of the second light-shielding layer wrap threads 410 are connected respectively to the plurality of the second front layer-connecting parts 112.

In a plurality of third light-shielding layers 500, the third light-shielding layer wrap threads 510 and the third light-shielding layer weft threads (not shown) are woven entirely, the third light-shielding layer wrap threads 510 are woven to the rear layer weft threads such that one ends of the third light-shielding layer wrap threads 510 are connected respectively to the plurality of the third rear layer-connecting parts 213, and the third light-shielding layer wrap threads 510 are woven to the front layer weft threads such that the other ends of the third light-shielding layer wrap threads 510 are connected respectively to the plurality of the third front layer-connecting parts 113.

In view of a path through which the light-shielding layer wrap threads are woven, the first light-shielding layer wrap threads 310 repeat a process of forming the first front layer-connecting parts 111 in association with the front layer wrap threads 101 and the front layer weft threads, being exposed out of the front part 120 up to starting points of the second front layer-connecting parts 112 without crossing with weft threads, passing through the third light-shielding layers 500 and crossing to the rear layer 200 to form the first rear layer-connecting parts 211 in association with the rear layer wrap threads 201 and the rear layer weft threads, being woven to the light-shielding layer weft threads to form the first light-shielding layers 300, and forming the first front layer-connecting parts 111 at the next position.

The second light-shielding layer wrap threads 410 repeat a process of forming the second front layer-connecting parts 112 in association with the front layer wrap threads 101 and the front layer weft threads, being exposed out of the front part 120 up to starting points of the third front layer-connecting parts 113 without crossing with weft threads, passing through the first light-shielding layers 300 and crossing to the rear layer 200 to form the second rear layer-connecting parts 212 in association with the rear layer wrap threads 201 and the rear layer weft threads, being woven to the light-shielding layer weft threads to form the second light-shielding layers 400, and forming the second front layer-connecting parts 112 at the next position.

The third light-shielding layer wrap threads 510 repeat a process of forming the third front layer-connecting parts 113 in association with the front layer wrap threads 101 and the front layer weft threads, being exposed out of the front part 120 up to starting points of the first front layer-connecting parts 111 without crossing with weft threads, passing through the second light-shielding layers 400 and crossing to the rear layer 200 to form the third rear layer-connecting parts 213 in association with the rear layer wrap threads 201 and the rear layer weft threads, being woven to the light-shielding layer weft threads to form the third light-shielding layers 500, and forming the third front layer-connecting parts 113 at the next position.

Figure 2:
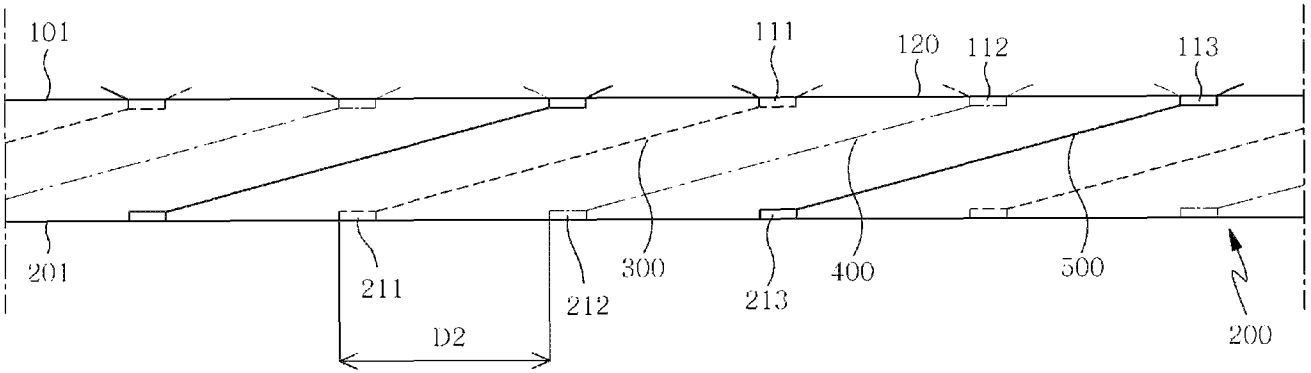
FIG. 2 is a view illustrating a state that wrap threads of a first to a third light-shielding layers of FIG. 1 are sheared on a front layer.

Thus, since the respective light-shielding layer wrap threads are simply woven up to the starting points of the rear layer-connecting parts without the weft threads after forming the front layer-connecting parts, the exposed wrap threads have to be sheared as illustrated in FIG. 2 in order to be woven into a three-dimensional woven fabric after manufacturing.

The above-described three-dimensional woven fabric may be produced by a method as described below.

The front weft threads are woven to the front layer wrap threads 101 to form the front layer 100.

The front layer 100 and the rear layer 200 are sequentially and repeatedly connected to the first light-shielding layers, the second light-shielding layers, and the third light-shielding layers, which are woven with the light-shielding layer wrap threads and weft threads, while the rear layer weft threads are woven to the rear layer filings 201 so as to form the rear layer 200 in the state of being spaced apart from a preset distance D3 from the front layer 100 to be parallel thereto, wherein the first light-shielding layer wrap threads 310 repeat a process of forming the first front layer-connecting parts 111 in association with the front layer wrap threads 101 and the front layer weft threads, being exposed out of the front part 120 up to starting points of the second front layer-connecting parts 112 without crossing with weft threads, passing through the third light-shielding layers 500 and crossing to the rear layer 200 to form the first rear layer-connecting parts 211 in association with the rear layer wrap threads 201 and the rear layer weft threads, being woven to the light-shielding layer weft threads to form the first light-shielding layers 300, and forming the first front layer-connecting parts 111 at the next position, the second light-shielding layer wrap threads 410 repeat a process of forming the second front layer-connecting parts 112 in association with the front layer wrap threads 101 and the front layer weft threads, being exposed out of the front part 120 up to starting points of the third front layer-connecting parts 113 without crossing with weft threads, passing through the first light-shielding layers 300 and crossing to the rear layer 200 to form the second rear layer-connecting parts 212 in association with the rear layer wrap threads 201 and the rear layer weft threads, being woven to the light-shielding layer weft threads to form the second light-shielding layers 400, and forming the second front layer-connecting parts 112 at the next position, the third light-shielding layer wrap threads 510 repeat a process of forming the third front layer-connecting parts 113 in association with the front layer wrap threads 101 and the front layer weft threads, being exposed out of the front part 120 to starting points of the first front layer-connecting parts 111 without crossing with weft threads, passing through the second light-shielding layers 400 and crossing to the rear layer 200 to form the third rear layer-connecting parts 213 in association with the rear layer wrap threads 201 and the rear layer weft threads, being woven to the light-shielding layer weft threads to form the third light-shielding layers 500, and forming the third front layer-connecting parts 113 at the next position, and, after weaving, the light-shielding wrap threads exposed to the outside of the front layer are removed to produce the three-dimensional woven fabric.

In the above-description, the distance D3 between the front layer and the rear layer is employed for the better comprehension of the drawings, but actually, the layers are adjacent to each other as illustrated in FIG. 3.

In the above-description, the light-shielding wrap threads are exposed to the outside of the front part, but actually, the light-shielding wrap threads may be provided at the outside of the rear part. Since the front layer and the rear layer are reversed according to a view direction, that is, when the woven fabric is reversed after weaving the fabric, this should be fall in the scope of the present invention.

If the weaving of the fabric according to the present invention were expressed by the number of healds simply, if it is assumed that the healds No. of the wrap threads of the front layer is 1/2, the healds No. of the wrap threads of the rear layer is 3/4, the healds No. of the wrap threads of the first light-shielding layer is 5/6, the healds No. of the wrap threads of the second light-shielding layer is 7/8, and the healds No. of the wrap threads of the third light-shielding layer is 9/10; the front part and the rear part are basically woven by the healds Nos. 1/2 and 3/4 respectively, the first connecting part of the front layer is woven by the healds Nos. 1/2/5/6, the second connecting part of the front layer is woven by the healds Nos. 1/2/7/8, and the third connecting part of the front layer is woven by the healds Nos. 1/2/9/10; and the first connecting part of the rear layer is woven by the healds Nos. 3/4/5/6, the second connecting part of the rear layer is woven the healds Nos. 3/4/7/8, and the third connecting part of the rear layer is woven by the healds Nos. 3/4/9/10.

Figure 7:
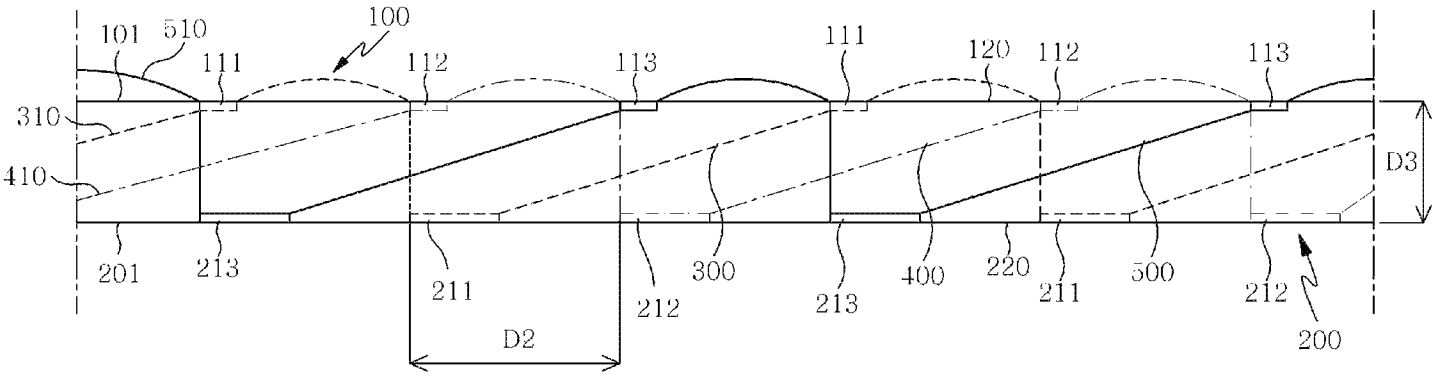
FIG. 7 is a schematic view illustrating a three-dimensional woven fabric according to a modified embodiment of the present invention.

In the embodiment, although the first to the third rear layer-connecting parts 211, 212, and 213 have the same lengths as those of the first to the third front layer-connecting parts 111, 112, and 113 as illustrated in FIGS. 1 to 6, the first to the third rear layer-connecting parts 211, 212, and 213 may have lengths longer than those of and shorter than the distances D2 between the first to the third front layer-connecting parts 111, 112, and 113, as illustrated in FIG. 7.

Figure 8:
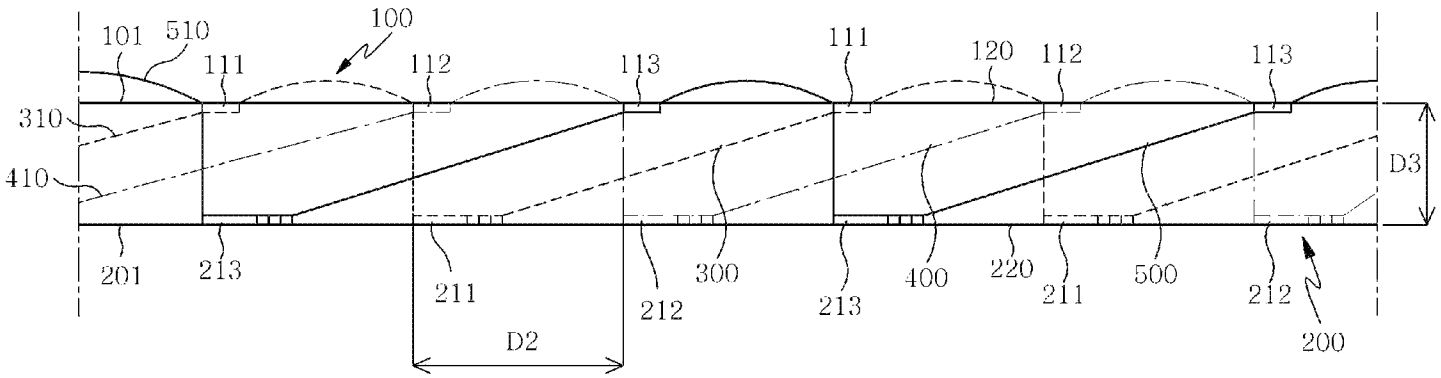
FIG. 8 is a schematic view illustrating a three-dimensional woven fabric according to a still modified embodiment of the present invention.

In still another modified embodiment, as illustrated in FIG. 8, the first to the third rear layer-connecting parts 211, 212, and 213 have the same lengths as those of the first to third rear layer-connecting parts 211, 212, and 213 of the modified embodiment and the first to the third light-shielding wrap threads 310, 410, and 510 may be woven with the rear layer wrap threads 201 and the rear layer weft threads to form the first to the third rear layer-connecting parts 211, 212, and 213 such that initial portions of the first to the third rear layer-connecting parts are woven densely by a preset length and the rests thereof are woven intermittently.

INDUSTRIAL APPLICABILITY

In the embodiment, the dense weaving of the light-shielding layer is to form the light-shielding structure by making the density of the weft threads high or using thick weft threads because thickness and density of the light-shielding wrap threads are uniform. According to the present invention, since the light-shielding layers are overlapped doubly, the light-shielding layers have a half-light-shielding structure such that light is completely shielded when the three-dimensional woven fabric is fully folded (See FIG. 6), that some of the light transmits through the half-light-shielding structure when the woven fabric is unfolded half (See FIG. 5), and that a great deal of the light passes through the woven fabric through non-light-shielding structure when the woven fabric is fully unfolded (See FIG. 4), then the quantity of light transmission can be controlled.

Figure 9:
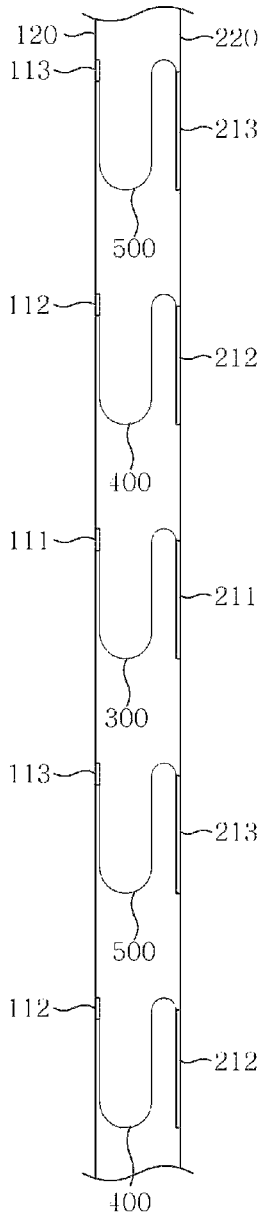
FIG. 9 is side view illustrating a state that the three-dimensional woven fabric of FIG. 7 is completely unfolded.
Figure 10:
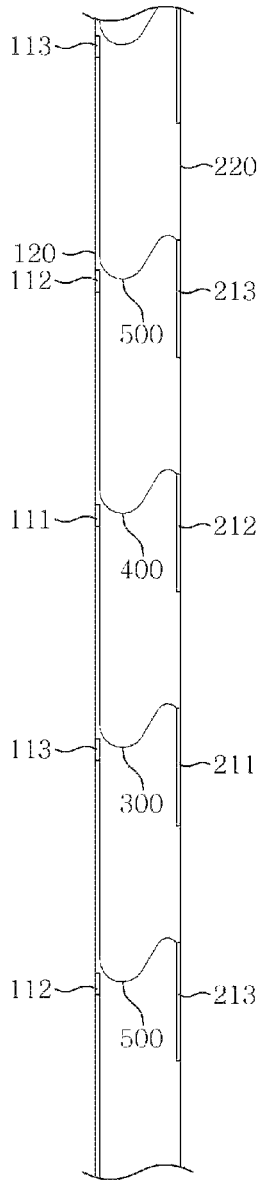
FIG. 10 is a side view illustrating a state that the three-dimensional woven fabric of FIG. 7 is unfolded about half.
Figure 11:
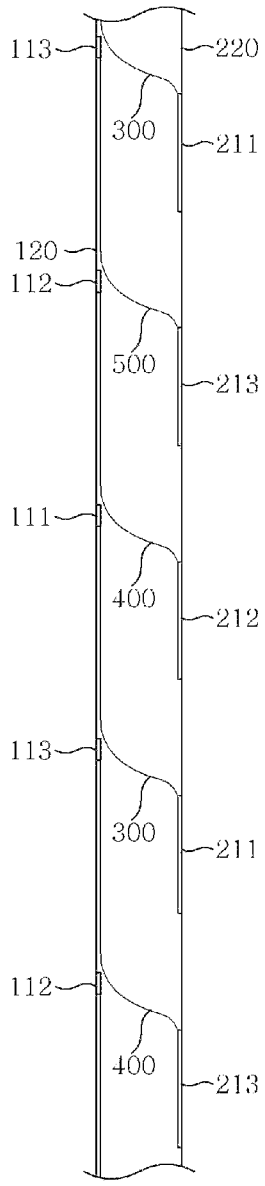
FIG. 11 is a side view illustrating a state that the three-dimensional woven fabrics of FIG. 7 are overlapped with each other.

Even in the modified embodiment and another modified embodiments, like in the embodiment, since the light-shielding layers are overlapped doubly, the light-shielding layers have a half-light-shielding structure such that light is completely shielded when the three-dimensional woven fabric is fully folded (See FIG. 11), that some of the light transmits through the half-light-shielding structure when the woven fabric is unfolded half (See FIG. 10), and that a great deal of the light passes through the woven fabric through non-light-shielding structure when the woven fabric is fully unfolded (See FIG. 9), then the quantity of light transmission can be controlled. As illustrated in FIGS. 9 to 11, the first to third light-shielding layers 300, 400, and 500 have different curves according to a degree of unfolding of the three-dimensional woven fabric to express an aesthetical appearing.

The invention claimed is:

1. A three-dimensional woven fabric comprising: a front layer, a rear layer, and a light-shielding layer connecting the front layer to the rear layer, wherein the light-shielding layer is formed by repeatedly overlapping a first light-shielding layer, a second light-shielding layer, and a third light-shielding layer, with adjacent ones among the first to the third light-shielding layers overlapped, wherein the front layer includes front parts, in which front layer wrap threads and weft threads are basically woven, and first to third front layer-connecting parts, in which front layer wrap threads and wrap threads and weft threads forming the light-shielding layer are woven, which are sequentially and repeatedly formed, wherein the rear layer includes rear parts, in which rear layer wrap threads and weft threads are basically woven, and first to third rear layer-connecting parts, in which the rear layer wrap threads and wrap threads and weft threads forming the light-shielding layer are woven, which are sequentially and repeatedly formed, wherein the first to the third light-shielding layers are formed by weaving the wrap threads and the weft threads forming the light-shielding layer, wherein the first to third light-shielding layers are connected to the first to third front layer-connecting parts and the first to third rear layer-connecting parts sequentially and repeatedly, wherein the third rear layer-connecting parts are disposed on the rear layer facing the first front layer-connecting part on the front layer, wherein the first rear layer-connecting part is disposed on the rear layer facing the second front layer-connecting part on the front layer, wherein the second rear layer-connecting part is disposed on the rear layer facing the third front layer-connecting part on the front layer, wherein the first to the third rear layer-connecting parts are longer than the first to the third front layer-connecting parts and shorter than distances between the first to the third front layer-connecting parts, and wherein the light-shielding layer connected to the respective rear layer-connecting parts is overlapped with another light-shielding layer connected and adjacent to a front layer-connecting part directly above a next rear layer connecting part.

2. The three-dimensional woven fabric as claimed in claim 1, wherein the wrap threads forming the light-shielding layer are produced without crossing with the weft threads on the front side of the front parts and are exposed to the outside, and the exposed wrap threads are sheared after weaving.

3. The three-dimensional woven fabric as claimed in claim 1, wherein the light-shielding layers have a half light-transmittable structure.

4. The three-dimensional woven fabric as claimed in claim 1, wherein the first to the third rear layer-connecting parts are formed by weaving the first to the third light-shielding layer wrap threads with the rear layer wrap threads and the rear layer weft threads such that initial portions of the first to the third rear layer-connecting parts are woven densely by a preset length and the rests thereof are woven intermittently.

5. A method of producing a three-dimensional woven fabric comprising a front layer, a rear layer, and a light-shielding layer connecting the front layer to the rear layer, the method comprising:

weaving front layer weft threads to front layer wrap threads to form the front layer; and connecting first light-shielding layers, second light-shielding layers, and third light-shielding layers, which have light-shielding wrap threads and light-shielding weft threads, to the front layer and the rear layer sequentially and repeatedly while the rear layer weft threads are woven to the rear layer wrap threads to form the rear layer in the state of being spaced apart by a preset distance from the front layer to be parallel thereto;

wherein the first light-shielding layer wrap threads of the first light-shielding layer repeat a process of forming first front layer-connecting parts in association with the front layer wrap threads and the front layer weft threads, being exposed out of the front part up to the starting points of the second front layer-connecting parts without crossing with weft threads, passing through the third light-shielding layer and crossing to the rear layer to form the first rear layer-connecting parts in association with the rear layer wrap threads and the rear layer weft threads, being woven to the light-shielding layer filings to form the first light-shielding layers, and forming the first front layer-connecting parts at the next position;

wherein the second light-shielding layer wrap threads of the second light-shielding layer repeat a process of forming the second front layer-connecting parts in association with the front layer wrap threads and the front layer weft threads, being exposed out of the front part up to starting points of the third front layer-connecting parts without crossing with weft threads, passing through the first light-shielding layers and crossing to the rear layer to form the second rear layer-connecting parts in association with the rear layer wrap threads and the rear layer weft threads, being woven to the light-shielding layer weft threads to form the second light-shielding layers, and forming the second front layer-connecting parts at the next position;

wherein the third light-shielding layer wrap threads of the third light-shielding layer repeat a process of forming the third front layer-connecting parts in association with the front layer wrap threads and the front layer weft threads, being exposed out of the front part up to starting points of the first front layer-connecting parts without crossing with weft threads, passing through the second light-shielding layers and crossing to the rear layer to form the third rear layer-connecting parts in association with the rear layer wrap threads and the rear layer weft threads, being woven to the light-shielding layer weft threads to form the third light-shielding layers, and forming the third front layer-connecting parts at the next position; and wherein the first to the third light-shielding layer wrap threads exposed out of the front layer are removed after weaving.

6. A method of producing a three-dimensional woven fabric comprising a front layer, a rear layer, and a light-shielding layer connecting the front layer to the rear layer, the method comprising:

weaving a front part and a rear part by healds Nos. 1/2 and 3/4 respectively, first, second and third connecting parts of the front layer by healds Nos. 1/2/5/6, 1/2/7/8, and 1/2/9/10 respectively, and first to third connecting parts of the rear layer by heald frame Nos. 3/4/5/6, 3/4/7/8, and 3/4/9/10 respectively, wherein wrap threads of the front layer are expressed by the healds Nos. 1/2, wrap threads of the rear layer are expressed by the healds Nos. 3/4, first light-shielding layer wrap threads are expressed by the healds Nos. 5/6, second light-shielding layer wrap threads are expressed by the healds Nos. 7/8, and third light-shielding layer wrap threads are expressed by the heald frame Nos. 9/10;

wherein the front part in which front layer wrap threads and front layer weft threads are woven and first to third front layer-connecting parts, in which the front layer wrap threads and wrap threads and weft threads forming the light-shielding layer are woven, are sequentially and repeatedly formed on the front layer;

wherein rear parts, in which rear layer wrap threads and weft threads are woven, and first to third rear layer-connecting parts, in which the rear layer wrap threads and the wrap threads and weft threads forming the light-shielding layer are woven, are sequentially and repeatedly formed on the rear layer;

wherein the first to the third light-shielding layers formed by the wrap threads and weft threads forming the light-shielding layer, are sequentially and repeatedly connected to the front layer and the rear layer; and wherein the light-shielding wrap threads exposed to the outside of the front parts during the weaving are removed by shearing after weaving;

wherein the third rear layer-connecting parts are disposed on the rear layer facing the first front layer-connecting part on the front layer, wherein the first rear layer-connecting part is disposed on the rear layer facing the second front layer-connecting part on the front layer, wherein the second rear layer-connecting part is disposed on the rear layer facing the third front layer-connecting part on the front layer, wherein the first to the third rear layer-connecting parts are longer than the first to the third front layer-connecting parts and shorter than distances between the first to the third front layer-connecting parts.

7. The three-dimensional woven fabric as claimed in claim 2, wherein the light-shielding layers have a half light-transmittable structure.

8. The three-dimensional woven fabric as claimed in claim 2, wherein the first to the third rear layer-connecting parts are formed by weaving the first to the third light-shielding layer wrap threads with the rear layer wrap threads and the rear layer weft threads such that initial portions of the first to the third rear layer-connecting parts are woven densely by a preset length and the rests thereof are woven intermittently.

* * * * *